United States Patent [19]

West

[11] Patent Number: 4,461,697

[45] Date of Patent: Jul. 24, 1984

[54] SLACK WAX DE-OILING PROCESS

[75] Inventor: Theodore H. West, Sarnia, Canada

[73] Assignee: Exxon Research and Engineering Co., Florham Park, N.J.

[21] Appl. No.: 421,247

[22] Filed: Sep. 22, 1982

[51] Int. Cl.[3] ..... C10G 73/06

[52] U.S. Cl. ..... 208/31; 208/33

[58] Field of Search ..... 208/31, 33

[56] References Cited

U.S. PATENT DOCUMENTS

| | | | |
|---|---|---|---|
| 2,265,139 | 12/1941 | Brandt | 208/31 |
| 2,284,607 | 5/1942 | Marshall | 208/33 |
| 2,410,483 | 11/1946 | Dons et al. | 208/33 |
| 2,734,849 | 2/1956 | Gross et al. | 208/31 |
| 2,748,056 | 5/1956 | Backlund et al. | 208/31 |
| 2,882,215 | 4/1959 | Dale | 208/31 |
| 3,644,195 | 2/1972 | Gudelis | 208/31 |
| 3,871,991 | 3/1975 | Shaw | 208/33 |
| 4,111,790 | 9/1978 | West | 208/33 |
| 4,146,461 | 3/1979 | Broadhurst et al. | 208/33 |
| 4,169,039 | 9/1979 | Bushnell | 208/33 |
| 4,368,112 | 1/1983 | Thompson et al. | 208/31 |

*Primary Examiner*—Delbert E. Gantz
*Assistant Examiner*—Glenn A. Caldarola
*Attorney, Agent, or Firm*—Edward H. Mazer

[57] ABSTRACT

An improved method for separating a slack wax into a wax fraction and a lube oil fraction is disclosed. The method comprises passing the slack wax into a first mixing zone and subsequently into a second mixing zone. Solvent selectively miscible with the lube oil fraction is added to the zones. The temperature of the solvent added to the second mixing zone is substantially higher than the temperature of the solvent added to the first mixing zone. This process produces a wax fraction having a relatively low lube oil content.

16 Claims, 1 Drawing Figure

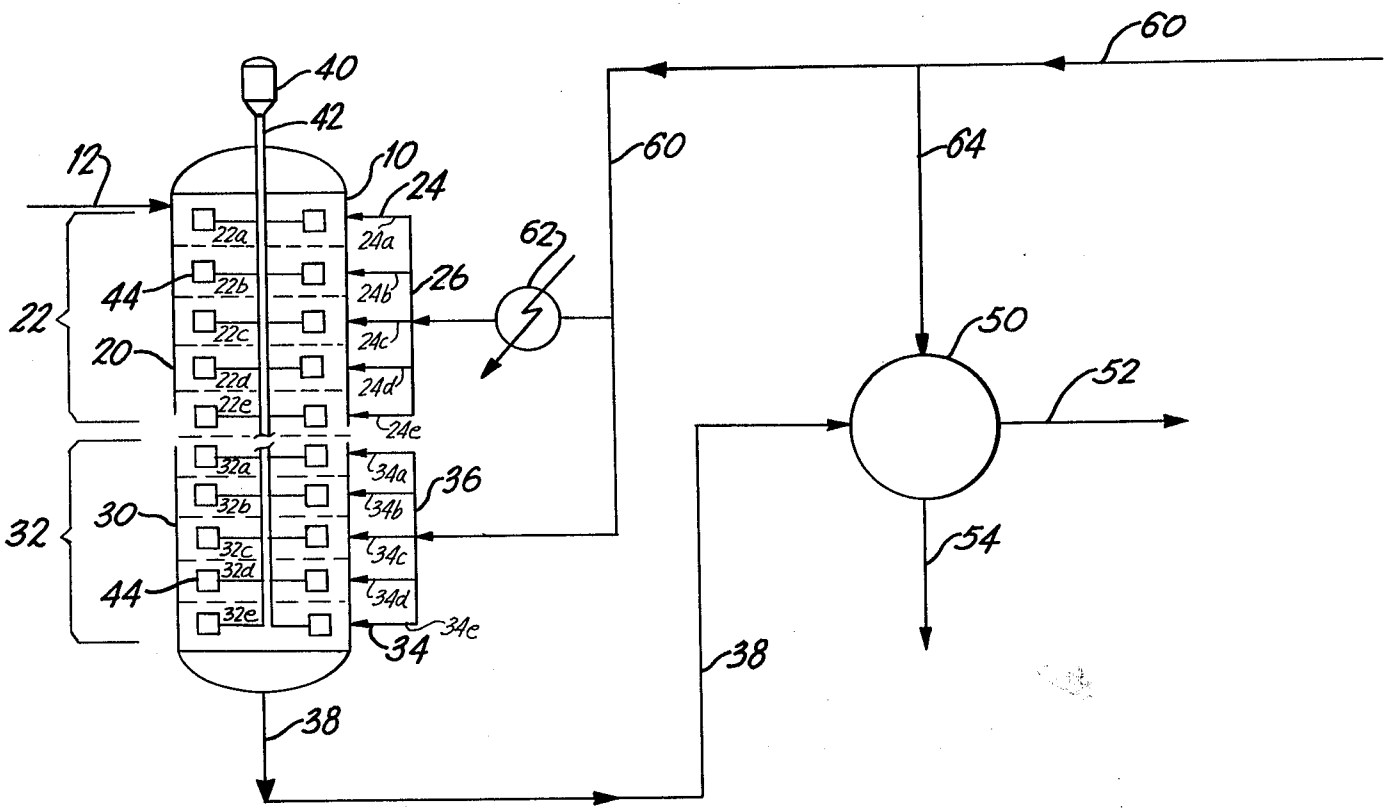
60
64
50
52
54
60
62
38
10
24
26
24a
24b
24c
24d
24e
36
34
34a
34b
34c
34d
34e
40
42
22a
22b
22c
22d
22e
32a
32b
32c
32d
32e
38
44
20
30
44
12
22
32

SLACK WAX DE-OILING PROCESS

BACKGROUND OF THE INVENTION

This invention is directed at the separation of a crystallized component from a slurry. More specifically the subject invention is directed at the separation of high melting point refined wax from a slack wax feed stream.

In the production of lube oils and waxes it is important to effect a good separation of the lube oil from the wax. The presence of wax in lube oil adversely affects the pour point of the oil, while the presence of lube oil in wax is not desirable for several reasons. Since the unit price of lube oil products typically is higher than that of wax products, eonomic considerations dictate that the oil content of the wax be as low as possible. In addition, many refined wax products, such as those used in contact with food, require that the residual oil content be maintained below a predetermined value. The removal of oil from wax typically has involved the use of a chilling zone to precipitate the wax, solvent addition to remove some of the residual oil from the wax, and a separation zone to remove the wax from the oil and solvent. Where the oil content of the wax is not reduced sufficiently in one separation stage, it may be necessary either to further process the wax or to utilize the wax in lower quality applications. Reprocessing the wax, such as by passing the wax through one or more separation zones, may not be desired because of the additional operating and capital costs. Previous work has been directed at the separation of lube oil from wax. U.S. Pat. No. 4,146,461 is directed at the dewaxing of waxy lubricating oil stocks by the injection of cold dewaxing solvents at a plurality of points. The patent discloses adjusting the cold solvent addition rate to each stage to ensure that the temperature drop in the initial stages is greater than the temperature drop in the final stages. U.S. Pat. No. 3,644,195 is directed at the separation of a waxy oil stream by adding cold solvent to a multi-stage mixing zone to crystallize the wax. The wax, separated from the lube oil by rotary filters, is again mixed with solvent at a temperature sufficient to dissolve low-melting wax only, after which the high-melting wax is separated by another rotary filter.

U.S. Pat. No. 2,284,607 is directed at a method of dewaxing oil. This patent discloses the chilling of the primary solvent and feed stream mixture and the subsequent addition of a secondary solvent at a higher temperature than the primary solvent-feed mixture. After the secondary solvent is added, the mixture again is chilled, after which the wax is separated.

U.S. Pat. No. 4,169,039 also is directed at dewaxing an oil. This patent discloses the use of a multi-stage mixing and crystallization zone in which relatively small amounts of the components from the hot washing drum are recirculated to the mixing zone, but at a lower temperature than the material being processed in the mixing zone.

In all of the patents noted above the separation of the oil from the wax requires the use of additional quantities of solvent and/or additional processing steps. Accordingly, it is desirable to provide a process which will reduce the residual oil content in wax to relatively low values without the use of additional processing equipment or additional processing steps.

It also is desirable to provide a process which will reduce the residual oil content in wax to relatively low levels without the use of excessive amounts of solvent.

It also is desirable to provide a process which will permit a decrease in the wash solvent addition rate without increasing the residual oil content of the wax above a predetermined limit.

The subject invention is directed at a method for separating a first, crystallized component from a second, non-crystallized component by passing the feed stream comprising the first and second components through first and second mixing zones. Solvent is added to both mixing zones, with the temperature of the solvent added to the first zone lower than that added to the second mixing zone. More specifically, the subject invention is directed at reducing the residual oil content of a wax fraction by passing the wax-containing feed stream through a first mixing zone where the feed stream is contacted with a solvent at a lower temperature than the feed stream to precipitate the wax and form a wax slurry. The slurry is then contacted in a second mixing zone with solvent at a higher temperature than the solvent added to the first mixing zone to remove residual oil from the wax fraction. The slurry exiting from the second mixing zone is passed to a separation zone for separation of the wax fraction from the slurry.

SUMMARY OF THE INVENTION

A method for separating a crystallizable component from a non-crystallizable component in a multicomponent feed stream, said method comprising:

A. adding solvent selectively miscible with the non-crystallizable component to a first mixing zone at a temperature below the temperature of the feed entering the first mixing zone to thereby crystallize at last a portion of the crystallizable component and form a slurry;

B. passing slurry from the first mixing zone to a second mixing zone wherein the slurry is contacted with additional quantities of solvent, the temperature of the solvent added to the second mixing zone being substantially higher than the temperature of solvent added to the first mixing zone to thereby remove quantities of the non-crystallized component from the crystallized component; and, C. passing slurry from the second mixing zone to a separation zone wherein the crystallized component is separated from the non-crystallized component and solvent.

The present invention is of particular utility where the feed stream is a slack wax which is to be separated into a wax fraction and a lube oil fraction. In such an application the present invention comprises:

A. passing slack wax into a first mixing zone and contacting the slack max therein with a solvent selectively miscible with the lube oil, the solvent added to the first mixing zone at a lower temperature than the temperature of the entering slack wax is thereby crystallize at least a portion of the wax and form a slurry;

B. passing slurry from the first mixing zone into a second mixing zone wherein the slurry is contacted with additional solvent, the temperature of the solvent added to the second mixing zone being higher than the temperature of the solvent added to the first mixing zone; and C. passing slurry from the second mixing zone into a separation zone wherein the slurry is separated into a crystalline wax fraction and a lube oil fraction.

In a preferred embodiment of the present invention the first and second mixing zones, each comprising a plurality of mixing stages, are disposed in a common vessel. The solvent added to both mixing zones preferably is the same. When the feed stream is a slack wax, the solvent preferably is selected from the group consisting of methyl ethyl ketone, methyl isobutyl ketone, acetone, toluene, ethylene dichloride, methylene chloride and mixtures thereof. The solvent added to the second mixing zone, typically comprising at least 30 wt% of the total solvent added, preferably is added at a temperature substantially the same as that of the slurry passing from the first mixing zone into the second mixing zone. The temperature of the solvent added to the second mixing zone preferably is at least about 15° C. higher, more preferably at least about 35° C. higher, than the temperature of the solvent added to the first mixing zone. The temperature of the solvent added to the second mixing zone preferably in not less than the temperature of the slurry entering the second mixing zone.

BRIEF DESCRIPTION OF THE DRAWING

The FIGURE is a simplified schematic flow diagram of one embodiment for practicing the present invention.

DETAILED DESCRIPTION OF THE INVENTION

Referring to the FIGURE, a preferred embodiment for practicing the present invention is shown. In the FIGURE, all valves, piping, pumps, instrumentation and other equipment not essential for an understanding of this invention have been deleted for clarity. A feed stream, such as a slack wax stream, is shown entering the top of crystallizer vessel 10 through line 12. Vessel 10 comprises a plurality of mixing zones, such as first mixing zone 20 and second mixing zone 30. Although first mixing zone 20 and second mixing zone 30 are shown located in the same vessel 10, each zone also may be located in one or more separate vessels. Zones 20, 30 each comprise one or more separate mixing stages, such as stages 22 a–e, 32 a–e, respectively. In this embodiment, tower 10 has a central shaft 42 which communicates with drive means 40 and with impeller means 44 disposed in each stage 22 a–e, 32 a–e. Stages 22 a–e, 32 a–e are shown having fresh solvent inlets 24 a–e, 34 a–e, respectively, extending from manifolds 26, 36, respectively. Line 38, extending from the base of vessel 10, transports the slurry exiting from zone 30 to a separation zone 50. Zone 50 may comprise any equipment reasonably adapted to separate the products being processed. In a lube oil-wax separation process, separation zone 50 preferably comprises a rotary filter means, although other separating equipment also may prove satisfactory. The slurry in line 38 preferably is contacted in separation zone 50 with additional solvent entering through line 64 to facilitate the oil-wax separation. The wax fraction comprising crystalline wax and solvent, is separated and is removed via line 52 while the lube oil fraction comprising lube oil, low melting point wax and solvent exits zone 50 through line 54.

A critical element of the present invention is the addition of solvent to first mixing zone 20 through manifold 26 and inlets 24 a–e at a temperature than the temperature of the solvent added to second mixing zone 30 through manifold 36 and inlets 34 a–e. In the embodiment shown this may be accomplished by passing a fraction of the solvent in line 60 through an additional refrigeration zone, such as zone 62, before the solvent enters manifold 26. In first mixing zone 20 the relatively cold solvent operates to cool the feed stream thereby crystallizing at least one crystallizable component from the feed stream. The relatively warm solvent added to second mixing zone 30 through line 60, manifold 36 and inlets 34 a–e operates to dissolve certain of the low melting crystals and to remove residual liquid from the remaining crystals. As used herein, the term "crystallizable component" means a component which forms crystals at the temperature of the solvent utilized, while the term "non-crystallizable component" means a component which is not crystallized at the temperature of the solvent utilized.

One particularly useful application of the present invention is in the processing of a slack wax stream from a lube oil process. The slack wax, typically comprises about 60 wt.% or more wax with the remainder generally comprising lube oil. The slack wax preferably is passed through a multi-stage contacting vessel, such as vessel 10, where the solvent added to stages 22 a–e of first mixing zone 20 through line 60, refrigeration zone 62, manifold 26 and inlets 24 a–e operates to gradually cool the slack wax thereby promoting the desired wax crystal growth. The wax-oil-solvent slurry then passes into second mixing zone 30 having stages 32 a–e. The solvent added to stages 32 a–e through line 60, manifold 36, and inlets 34 a–e operates largely to dissolve low melting point wax compounds and remove entrapped lube oil from the remaining wax crystals. The slurry thereafter may be transferred to separation zone 50, such as a rotary filter means, where the wax fraction may be separated from the lube oil fraction by methods well-known in the art. The wax fraction, primarily comprising crystalline wax and solvent, may be removed from separation zone 50 through line 52 for further separation of the crystalline wax from the solvent (not shown). Typically, this is accomplished in a distillation zone. Similarly, the lube oil fraction, primarily comprising lube oil, low melting point wax and solvent, may be removed from separation zone 50 through line 54 for further separation of the lube oil and low melting point wax from the solvent. The lube oil and low melting point wax, which commonly are referred to as foots oil, also frequently are separated from the solvent in a distillation zone.

Vessels substantially similar to vessel 10 previously have been used for slack wax processing. It may be possible to modify an existing contacting vessel wherein all the solvent is added at substantially the same temperature, to the present design wherein the solvent is added at a plurality of temperatures to the mixing zones. The following examples demonstrate that a conventional contacting vessel, modified generally as shown in the FIGURE, may produce a wax product having a significantly lower residual oil content than that achieved by a conventional process at the same overall solvent addition rate. In these examples a one stage laboratory crystallizer six inches in diameter and three inches high was used in batchwise operation to simulate operation of a fourteen stage continuous contacting vessel. Solvent was added incrementally to the feed and mixed for a predetermined time at the appropriate temperature to simulate the dilution and mixing which occurs at each particular stage in a continuous contacting vessel.

The feed used in these tests was a slack wax from a 600 Neutral feedstock having 30 wt.% oil content. Certain properties of this slack wax are presented in Table 1 below.

TABLE 1

Properties of Slack Wax Tested

Oil Content—30 wt.% of SAE 30 grade oil
Viscosity—8.5 cps @ 100° C.
ASTM Congealing Point—64° C.
Specific Gravity—0.8 @ 80° C.

Comparative tests were run in which the feed rate to vessel 10 was 350 cc/min. The feed was prediluted with 0.5 v/v of a solvent comprising equal volumes of methyl ethyl ketone and methyl isobutyl ketone. The agitator tip speed was maintained at 305 cm/sec. In all tests the slurry exited from vessel 10 through line 38 at 25° C.

In a conventional cold solvent addition test where vessel 10 comprised a single mixing zone, such as first mixing zone 20, the temperature of the slack wax was reduced substantially uniformly from 57° C. to 10° C. at an average chilling rate of 1.7° C./min. The solvent added to vessel 10 was maintained at a temperature of −13° C. for all solvent additions.

In another comparative test substantially similar to that for the cold solvent addition, but using a relatively warm solvent, feed entering at a temperature of 57° C. was reduced substantially uniformly to an outlet temperature of 25° C. at an average cooling rate of 1.7° C./min by the addition of solvent at a temperature of 9° C. Varying amounts of wash solvent were used in the subsequent processing of the slurry from the crystallizer.

EXAMPLE 1

In this example, substantially all the feed cooling was accomplished in the simulated first mixing zone 20 comprising stages 1–7. The cooling rate was increased to 2.9° C./min by the incremental addition of solvent at −13° C. The slurry was cooled in the first mixing zone to 25° C. To simulate the second mixing zone 30, comprising stages 8–14, solvent subsequently was added incrementally at a temperature of 25° C. to dissolve low melting wax and remove entrapped lube oil from the remaining wax crystals. Varying amounts of wash solvent were used in the subsequent processing of the slurry from the crystallizer.

A comparison of the data for the two temperature solvent addition process of the present invention where the temperature of the solvent added to the first mixing zone and to the second mixing zone differed by approximately 38° C., with that for conventional one temperature warm and one temperature cold solvent addition processes is presented in Table 2. This data demonstrates that the two temperature solvent addition process produced a wax product having a reduced oil content. For example, a comparison of run 2, the lowest oil content wax with conventional warm solvent addition, and run 8, the lowest oil content with two temperature solvent addition, showed that the two temperature solvent addition process produced a wax having only about one-sixth the oil content of the conventional warm solvent addition process even though approximately 30% more wash solvent was used in the conventional case. Thus, use of the present invention may reduce the residual oil content of the wax and/or permit the use of less wash solvent without increasing the residual oil content of the wax above a predetermined limit.

TABLE 2

COMPARISON OF CONVENTIONAL AND TWO TEMPERATURE SOLVENT ADDITION

Feed: Arab Light 600 Neutral Slack Wax; Oil Content = 30%
Solvent: 50/50 v/v MEK/MIBK

| | Conventional Cold Solvent Addition | Conventional Warm Solvent Addition | | | | | | Two Temperature Solvent Addition | | |
|---|---|---|---|---|---|---|---|---|---|---|
| Tower Stages | 14 | | | 14 | | | | 14 | | |
| Solvent Temp °C. (Stages) | −13(1–14) | | | +9(1–14) | | | | −13(1–7) | +25(8–14) | |
| Tower Outlet °C. | 10 | | | 25 | | | | 25 | 25 | |
| Run No. | 1 | 2 | 3 | 4 | 5 | 6 | 7 | 8 | 9 | 10 |
| Slurry Dilution | 5.2 | 5.5 | 5.2 | 5.4 | 5.3 | 5.3 | 5.2 | 5.3 | 5.3 | 4.8 |
| Wash Solvent v/v | 1.6 | 2.4 | 1.5 | 1.04 | 0.77 | 0 | 2.2 | 1.79 | 1.36 | 0 |
| Wash Time/Filter Time | 1.0 | 1.0 | 0.71 | 0.47 | 0.41 | 0 | 1.0 | 0.81 | 0.6 | 0 |
| Total Solvent v/v | 6.8 | 7.9 | 6.7 | 6.44 | 6.07 | 5.3 | 7.4 | 7.09 | 6.66 | 4.8 |
| Performance | | | | | | | | | | |
| Wt. % Oil in Wax | 1.3 | 1.2 | 1.5 | 3.5 | 8.0 | 13.1 | 0.2 | 0.2 | 0.47 | 13.9 |
| Liquids/Solids w/w | 2.7 | 4.2 | 3.5 | 3.4 | 3.5 | 2.8 | 3.5 | 3.3 | 3.1 | 2.6 |
| Wax Congealing Point °C. | 67 | 70 | 70 | 69 | 69 | 67 | 70 | 69 | 69 | 67.5 |
| Wax Yield Wt. % on Slack Wax | 53 | 33.1 | 34.4 | 36.8 | 41.5 | 49.5 | 32.3 | 32.9 | 34.1 | 50.8 |

Another comparison test was performed in which a conventional warm solvent addition process was compared with a two temperature solvent addition process. The feed, feed rate, inlet feed temperature, dilution, solvent composition and agitator tip speed were substantially similar to those for the previously described tests. In the conventional 14 stage warm solvent addition process the temperature of the stack wax again was reduced substantially uniformly from 57° C. to an outlet temperature of 25° C. at a cooling rate of 1.5° C./min. by the addition of 9° C. solvent.

EXAMPLE II

In this example substantially all the feed cooling was accomplished in a first mixing zone, comprising stages 1–10, using solvent at a temperature of approximately 9° C. to simulate a cooling rate of 1.2° C./min. To reach the desired outlet temperature of 25° C. in 10 stages without using an excessive amount of solvent, auxiliary jacket chilling of the slurry was utilized. Additional solvent was added to a second mixing zone comprising stages 11–14, at substantially the same temperature as the second mixing zone slurry inlet temperature, 25° C.

Table 3 presents comparative data on this conventional warm solvent addition process, and the two temperature solvent addition process. From a comparison of the data in Table 3 it can be seen that the two temperature deoiling process, where the temperature difference between the solvent added to the first and second mixing zones differed by approximately 15° C., also produced a wax having a significantly lower oil content, even though less solvent had been used.

TABLE 3

COMPARISON OF CONVENTIONAL AND TWO TEMPERATURE SOLVENT ADDITION

Feed: Arab Light 600 Neutral Slack Wax; Oil Content = 30%
Solvent: 50/50 v/v MEK/MIBK

| | Conventional Warm Solvent Addition | Two Temperature Solvent Addition |
|---|---|---|
| Tower Stages | 14 | 14 |
| Solvent Temp. °C. (Stages) | +9(1–14) | +9(1–10)<br>+25(11–14) |
| Tower Outlet °C. | 25 | 25 |
| Run No. | 11 | 12 |
| Slurry Dilution | 5.8 | 5.3 |
| Wash Solvent v/v | 1.0 | 1.0 |
| Wash Time/Filter Time | 0.5 | 0.8 |
| Total Solvent v/v | 6.8 | 6.3 |
| Performance | | |
| Wt. % Oil in Wax | 5.0 | 2.1 |
| Liquids/Solids w/w | 3.46 | 2.3 |
| Wax Congealing Point, °C. | 69 | 69 |
| Wax Yield Wt. % on Slack Wax | 36.7 | 33.4 |

In the examples presented above, the temperature of the solvent added to the second mixing zone was substantially the same temperature as the slurry entering the second mixing zone. While it is not critical to the successful practice of this invention that the solvent and slurry added to the second mixing zone be at substantially the same temperature, frequently this will be the preferred method of operation, particularly if the solvent added to at least one of the zones requires some refrigeration. If the solvent utilized in the first mixing zone must be refrigerated to produce the desired cooling of the feed, addition of solvent to the second mixing zone at a significantly higher temperature than the slurry entering the second mixing zone would not be energy efficient, but would deoil the wax crystals. Conversely, addition of the solvent to the second mixing zone at a significantly lower temperature than that of the slurry entering the second mixing zone would promote additional crystallization and inhibit the desired removal of oil from the wax crystals. Since some variations may occur in the feed or solvent flow rates and/or temperatures, it may be desirable in some operations to add solvent to the second mixing zone at a slightly higher temperature than the normal temperature of the slurry entering the second mixing zone. This would assure that temperature and/or flow rate variations do not result in further crystallization of the slurry in the second mixing zone by the addition to the second mixing zone of solvent at a lower temperature that the slurry. The temperature of the solvent added to the second mixing zone preferably should be maintained to more than about 5° C. above the average temperature of the slurry entering the second mixing zone.

From the data of Tables 2 and 3 it can be seen that two temperature solvent addition permits a significant reduction in the oil content of the wax over one temperature solvent addition for similar solvent addition rates in similar crystallizer vessels.

The specific solvent temperatures to be utilized in each zone will be dependent upon many factors including the following: lube oil content of the wax feed stream; solvent addition rate; desired residual lube oil content in product wax stream; available solvent cooling capacity; and desired final wax product congealing point or melting point.

While the present invention has been described with particular reference to a specific multi-stage vessel which comprised the first and second mixing zones, it is clear that this invention also could be practiced utilizing other multi-stage vessel designs, or utilizing a plurality of mixing zones in separate vessels.

What is claimed is:

1. A method for separating a crystallizable component from a non-crystallizable component in a multi-component feed stream, said method comprising:

A. passing the feed stream into a first mixing zone and adding solvent selectively miscible with the non-crystallizable component to the first mixing zone at a temperature below the temperature of the feed entering the first mixing zone to thereby crystallize at least a portion of the crystallizable component and form a slurry;

B. passing slurry from the first mixing zone to a second mixing zone wherein the slurry is contacted with additional solvent, the temperature of the solvent added to the second mixing zone being not less than the temperature of the slurry entering the second mixing zone to thereby remove quantities of the non-crystallized component from the crystallized component; and C. passing slurry from the second mixing zone directly into a separation zone wherein crystallized component is separated from non-crystallized component and solvent.

2. The method of claim 1 wherein the crystallizable component comprises a wax fraction and wherein the non-crystallizable component comprises a lube oil fraction.

3. A method for separating slack wax into a crystalline wax fraction and a lube oil fraction comprising:

A. passing slack wax into a first mixing zone and contacting the slack wax therein with a solvent selectively miscible with the lube oil, the solvent added to the first mixing zone at a lower temperature than the temperature of the entering slack wax to thereby crystallize at least a portion of the wax and form a slurry;

B. passing slurry from the first mixing zone into a second mixing zone wherein the slurry is contacted with additional solvent, the temperature of the solvent added to the second zone being not less than the temperature of the slurry entering the second mixing zone; and C. passing slurry from the second mixing zone directly into a separation zone wherein the slurry is separated into a crystalline wax fraction and a lube oil fraction.

4. The method of claim 2 wherein the temperature of the solvent added to the second mixing zone is at least about 15° C. higher than the temperature of the solvent added to the first mixing zone.

5. The method of claim 4 wherein the temperature of the solvent added to the second zone is at least about 35° C. higher than the temperature of the solvent added to the first mixing zone.

6. The method of claim 3 wherein the first mixing zone and the second mixing zone are disposed in a common vessel.

7. The method of claim 6 wherein the first mixing zone and the second mixing zone each comprise a plurality of mixing stages.

8. The method of claim 3 wherein the solvent added to the first mixing zone and the solvent added to the second mixing zone have the same composition.

9. The method of claim 8 wherein at least 30 wt.% of the total solvent added is added to the second mixing zone.

10. The method of claim 3 wherein lube oil fraction is passed to a distillation zone for removal of solvent to produce a foots oil.

11. The method of claim 3 wherein crystalline wax fraction is passed to a distillation zone for removal of solvent to produce a crystalline wax.

12. A method for separating a slack wax into a crystalline wax fraction and a lube oil fraction, said method comprising:

A. passing the slack wax into a first mixing zone and contacting the slack wax therein with a solvent selectively miscible with the lube oil, the solvent added to the first mixing zone at a lower temperature than the temperature of the entering slack wax to thereby crystallize at least a portion of the wax and form a slurry;

B. passing slurry from the first mixing zone into a second mixing zone wherein the slurry is contacted with solvent at a higher temperature than the slurry to thereby remove at least a portion of lube oil entrapped in the wax fraction; and C. passing slurry from the second mixing zone directly into a separation zone wherein the slurry is separated into a crystalline wax fraction and a lube oil fraction.

13. A method for separating a slack wax into a crystalline wax fraction and a lube oil fraction, said method comprising:

A. passing the slack wax into a first mixing zone and contacting the slack wax therein with a solvent selectively miscible with the lube oil, the solvent selected from the group consisting of acetone, toluene, ethylene dichloride, methylene chloride and mixtures thereof, the solvent added to the first mixing zone at a lower temperature than the temperature of the entering slack wax to thereby crystallize at least a portion of the wax and form a slurry;

B. passing slurry from the first mixing zone into a second mixing zone and adding to the second mixing zone solvent having substantially the same composition as the solvent added to the first mixing zone, the solvent added to the second zone having a temperature no lower than the temperature of the slurry entering the second mixing zone, to remove entrapped lube oil from the crystallized wax; and C. passing slurry from the second mixing zone directly to a separation zone wherein the slurry is separated into a crystalline wax fraction and a lube oil fraction.

14. The method of claim 13 wherein lube oil fraction is passed to a distillation zone for removal of solvent to produce a foots oil.

15. The method of claim 13 wherein crystalline wax fraction is passed to a distillation zone for removal of solvent to produce a crystalline wax.

16. A method for separating a slack wax into a crystalline wax fraction and a lube oil fraction, said method comprising:

A. passing the slack wax into a first mixing zone and contacting the slack wax therein with a solvent selectively miscible with the lube oil, the solvent added to the first mixing zone at a lower temperature than the temperature of the entering slack wax to thereby crystallize at least a portion of the wax and form a slurry;

B. passing slurry from the first mixing zone into a second mixing zone wherein the slurry is contacted with solvent at a higher temperature than the slurry to thereby remove at least a portion of lube oil, entrapped in the wax fraction; and C. passing slurry from the second mixing zone directly into a separation zone wherein the slurry is separated into a crystalline wax fraction and a lube oil fraction.

* * * * *